US006486845B2

(12) United States Patent
Ogawa et al.

(10) Patent No.: US 6,486,845 B2
(45) Date of Patent: Nov. 26, 2002

(54) ANTENNA APPARATUS AND WAVEGUIDE FOR USE THEREWITH

(75) Inventors: Takaya Ogawa, Kawasaki (JP); Kiyoko Tokunaga, Tsukuba (JP); Noriaki Miyano, Kawasaki (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/811,450

(22) Filed: Mar. 20, 2001

(65) Prior Publication Data

US 2002/0011958 A1 Jan. 31, 2002

(30) Foreign Application Priority Data

Jun. 23, 2000 (JP) ..... 2000-189938

(51) Int. Cl.[7] ..... H01Q 3/00

(52) U.S. Cl. ..... 343/765; 343/757; 343/772; 343/882

(58) Field of Search ..... 343/757, 765, 343/772, 775, 878, 880, 881, 882; H01Q 3/00

(56) References Cited

U.S. PATENT DOCUMENTS 3,864,688 A * 2/1975 Hansen et al. ..... 343/756
5,708,447 A * 1/1998 Kammer et al. ..... 343/840
5,870,062 A * 2/1999 Cox ..... 343/781 R
5,905,474 A * 5/1999 Ngai et al. ..... 343/840
6,198,452 B1 * 3/2001 Beheler et al. ..... 343/757
6,204,822 B1 * 3/2001 Cardiasmenos et al. .... 343/761

FOREIGN PATENT DOCUMENTS

JP 2000-165131 6/2000

* cited by examiner

*Primary Examiner*—Tho G. Phan
(74) *Attorney, Agent, or Firm*—Oblon, Spivak, McClelland, Maier & Neustadt, P.C.

(57) ABSTRACT

An antenna apparatus is provided with two parabolic antennas which are attached to an X-axis and adapted to independently rotate about the X-axis. The X-axis is supported between both ends of a support rail in the shape of a semicircular arc to pass through the center of the arc. The support rail is adapted to slide and is thereby permitted to rotate about the central axis of the arc as a Y-axis. The support rail is placed on a rotating base 13 adapted to rotate about a Z-axis. The entire apparatus is covered with a radome. Each of the parabolic antennas is therefore permitted to rotate about each of the X, Y and Z-axes. By controlling each axis driving mechanism according to the locations and orbits of two satellites, each of the parabolic antennas is permitted to track a respective one of the satellites.

21 Claims, 9 Drawing Sheets

ANTENNA APPARATUS AND WAVEGUIDE FOR USE THEREWITH

CROSS-REFERENCE TO RELATED APPLICATIONS

This application is based upon and claims the benefit of priority from the prior Japanese Patent Application No. 2000-189938, filed Jun. 23, 2000, the entire contents of which are incorporated herein by reference.

BACKGROUND OF THE INVENTION

1. Field of the Invention

The present invention relates to an antenna capable of tracking a number of communication satellites simultaneously and a waveguide available to transmission of transmit and receive signals associated with the antenna.

2. Description of the Related Art

At present about 200 communication satellites travel around the earth in low earth orbits. Thus, it is possible to communicate with at lest several satellites at any point on the earth. Satellite-based communication systems include the IRIDIUM system and the SKY BRIDGE system.

As antennas for communication satellites, parabolic antennas and phased-array antennas have heretofore been used widely.

An example of a parabolic antenna system is illustrated in FIGS. 1 and 2. The parabolic antenna system of FIG. 1 includes a post 101 set upright on the ground or the floor of a building, a shaft of rotation 102 attached to the upper portion of the post 101 in parallel so that it can revolve around the post, a gear 103*g* mounted to the rotation shaft 102, and a gear 103 which engages with the gear 102*g* and is rotated by a motor not shown.

The upper portion of an electromagnetic-wave focusing unit (hereinafter referred to as the reflector unit) 120 is attached to the top of the shaft 102 through a bracket 111 so that it can rotate in the up-and-down direction. The lower portion of the reflector unit 120 is attached to the end of a rod 112*a* in a cylinder unit 112 mounted to the lower portion of the shaft 102. A feed 130 is placed at the point at which electromagnetic waves are focused.

The parabolic antenna 100 thus constructed allows the azimuth of the reflector unit 120 to be controlled by driving the motor to thereby cause the shaft 102 to revolve around the post 101 through the gears 103 and 102*g*. On the other hand, the angle of elevation of the reflector unit 120 can be controlled by driving the cylinder unit 112. In this manner, the parabolic antenna can orient its reflector unit 120 to a communication satellite to transmit or receive electromagnetic waves to or from the satellite under good conditions.

However, with the conventional parabolic antenna system, one feed 130 is associated with one reflector unit 120. If there are two satellites to be tracked, therefore, the same number of parabolic antenna systems are required.

Two parabolic antenna systems must be placed so that they do not interfere with each other. For example, when the reflector unit 120 has a circular shape and measures 45 cm in diameter, two reflector units must be placed on the horizontal plane at a distance of about 3 m apart from each other as shown in FIG. 2 in order to prevent one reflector unit from projecting its shadow on the other.

However, such an antenna system as shown in FIG. 2 requires a large space for installation and is therefore not suited for household use.

BRIEF SUMMARY OF THE INVENTION

As described above, the conventional antenna apparatus capable of tracking two communication satellites simultaneously requires large space for installation. An antenna apparatus which is capable of tracking two communication satellites which is compact and requires less installation space is therefore in increasing demand.

With such an antenna apparatus, to make it compact, it is required to bend a waveguide used to couple a transmit-receive module and a primary radiator (feed) together. However, since two perpendicularly polarized waves of different frequencies are used for transmit and receive signals, it is required to prevent electrical characteristics from degrading in waveguide bends.

It is therefore an object of the present invention to provide an antenna apparatus which is capable of tracking two satellites simultaneously which is so compact that it can be installed in relatively small space.

It is another object of the present invention to provide a waveguide which, in transmitting two perpendicularly polarized waves of different frequencies, prevents electrical characteristics from degrading in its bends.

To attain the first object, an antenna apparatus of the present invention comprises: a fixed base having a datum plane and fixed in an installation place; a rotating base placed on the fixed base and adapted to be rotatable about a Z axis perpendicular to the datum plane; a support rail in the shape of substantially a semicircular arc, the rail being placed over the rotating base and adapted to be rotatable about a Y axis perpendicular to the Z axis with its central point on the Z axis and the Y axis passing through the central point of the support rail; first and second rotating shafts provided between an end of the support rail and the central point and between the other end of the support rail and the central point, respectively, to form an X axis perpendicular to the Y axis and adapted to be rotatable about the X axis independently of each other; first and second antennas fixed to the first and second rotating shafts, respectively; a Z-axis rotating mechanism for allowing the fixed base to rotate about the Z axis; a Y-axis rotating mechanism for allowing the support rail to rotate about the Y axis; first and second X-axis driving mechanisms for rotating the first and second rotating shafts about the X axis independently of each other; and a radome placed on the fixed base for covering the entire apparatus.

The antenna apparatus thus constructed allows each of the first and second antennas to rotate about each of the three axes independently, allowing the tracking of low-earth orbit satellites.

To attain the second object, there is provided a bent waveguide for transmitting two signals of different frequencies in the form of two polarized waves perpendicular to each other, characterized in that the waveguide is rectangular in cross section and its height and width are determined according to the polarized waves and the frequencies of the two signals.

The waveguide thus constructed allows the generation of the higher mode and crosstalk to be suppressed in its bends.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described hereinafter with reference to FIGS. 3 through 12.

Figure 1:
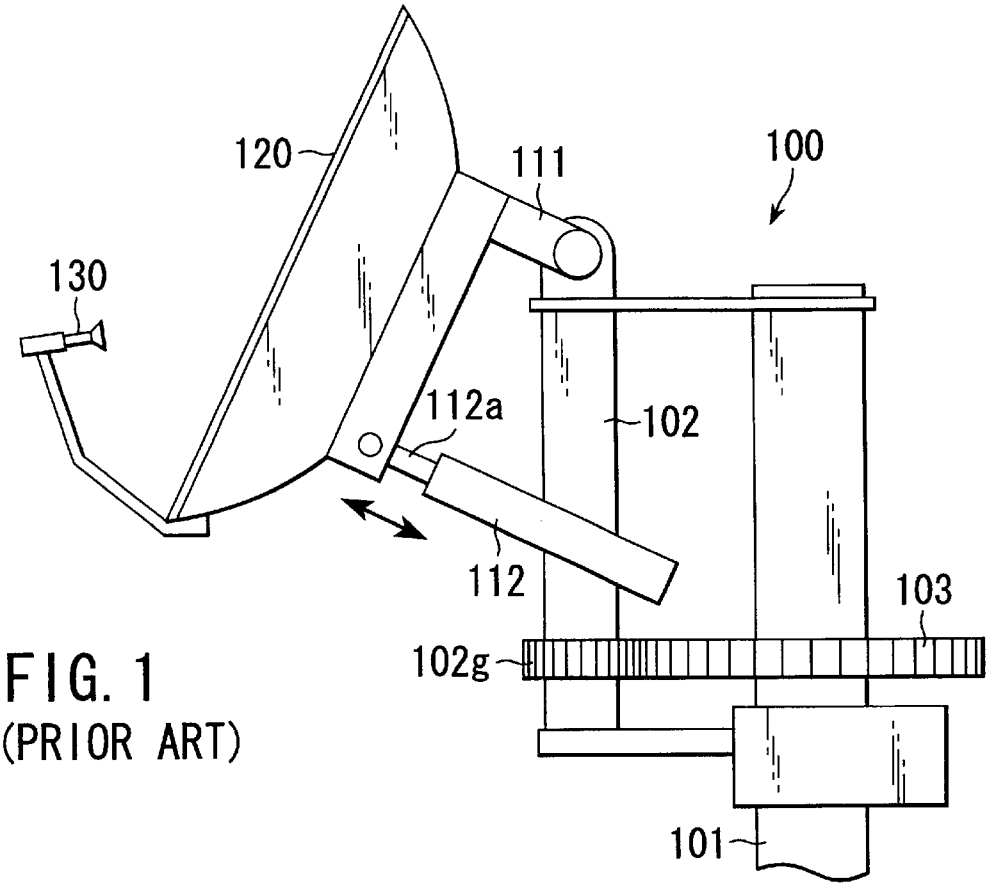
FIG. 1 (PRIOR ART)
FIG. 1 is a schematic illustration of a conventional parabolic antenna apparatus.
Figure 2:
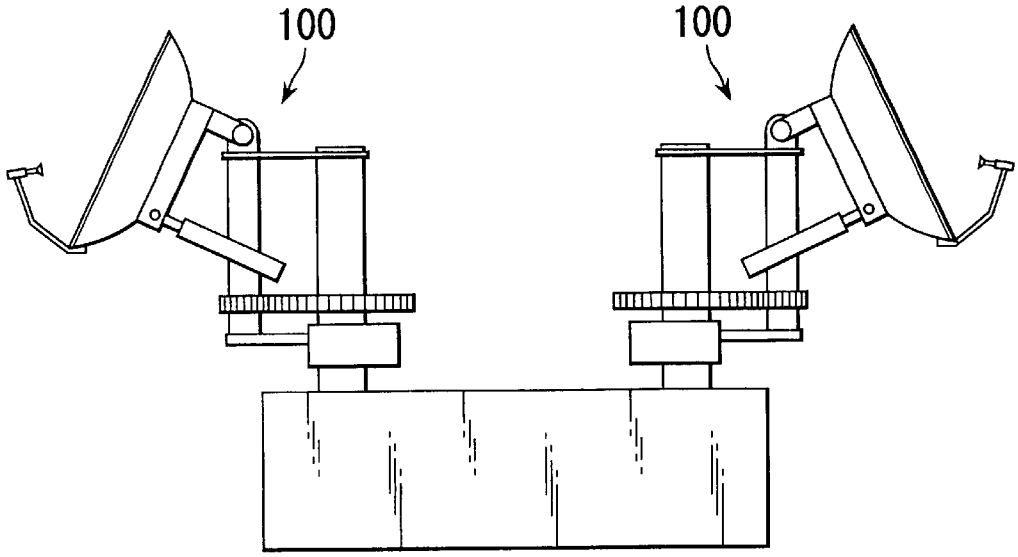
FIG. 2 (PRIOR ART)
FIG. 2 is a diagram for use in explanation of the way of tracking two low-earth orbit satellites using the conventional parabolic antenna apparatus of FIG. 1.
Figure 3:
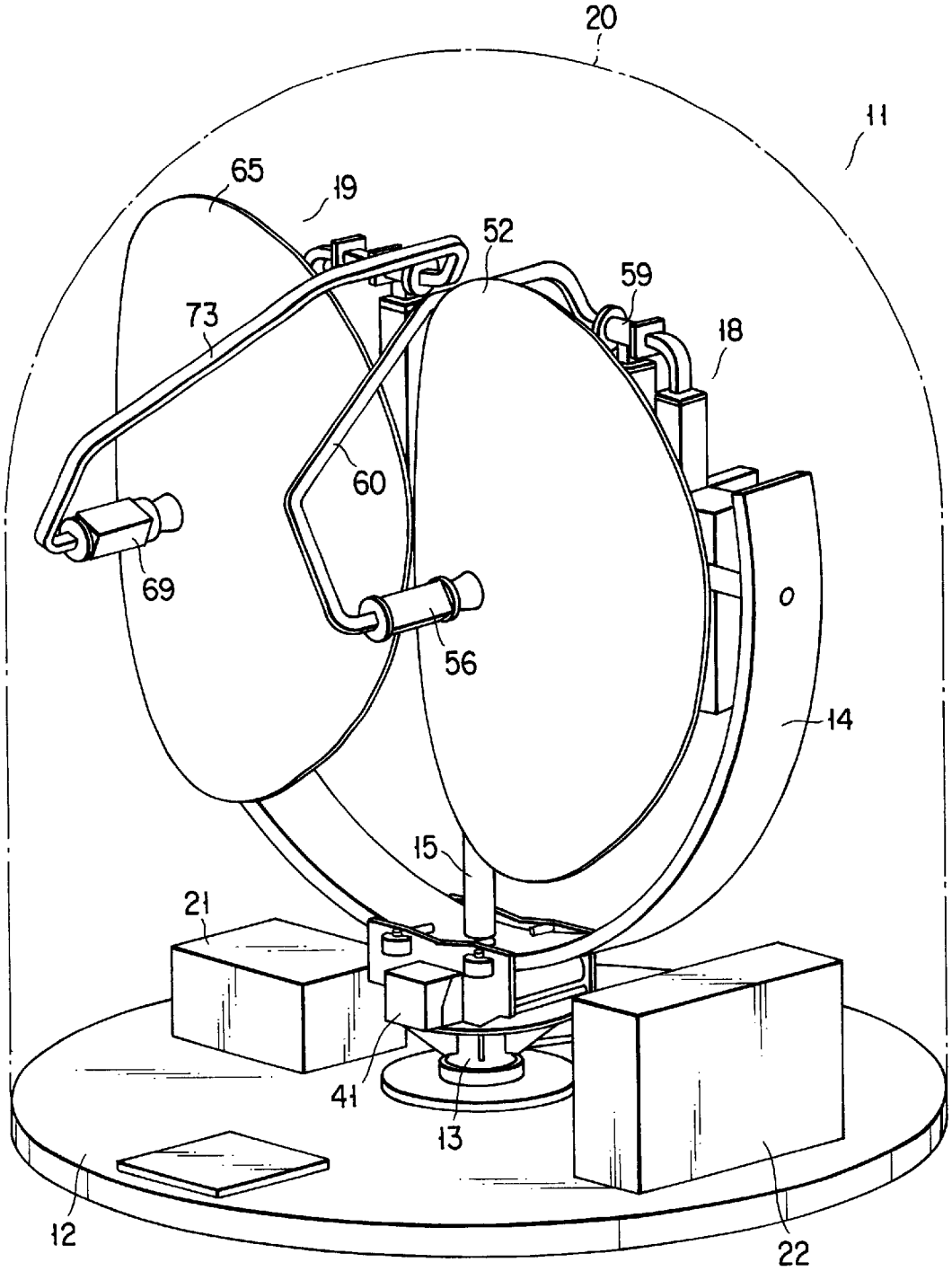
FIG. 3 is a schematic perspective view of an antenna apparatus according to an embodiment of the present invention.
Figure 4:
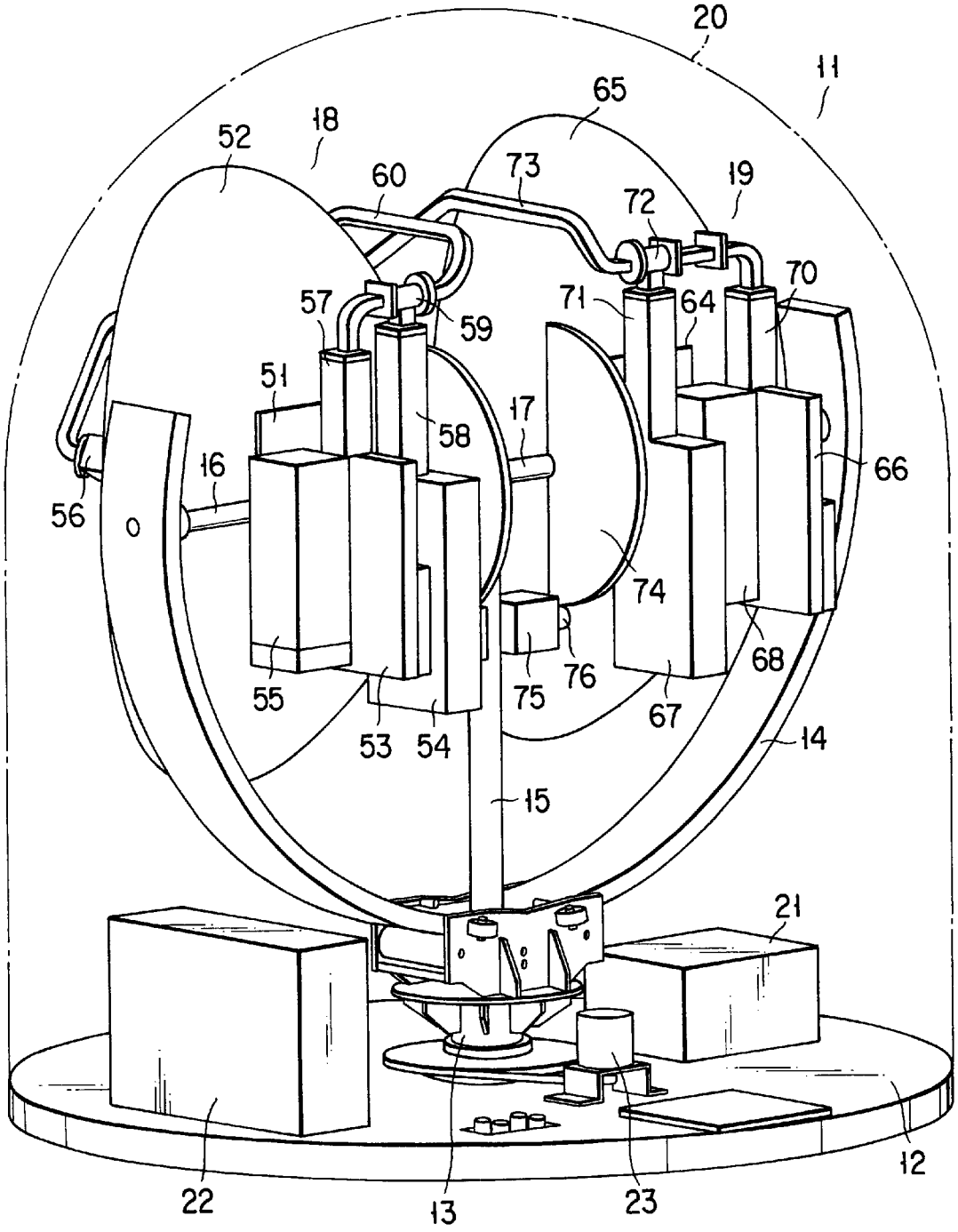
FIG. 4 is a perspective rear view of the antenna apparatus of FIG. 3.
Figure 5B:
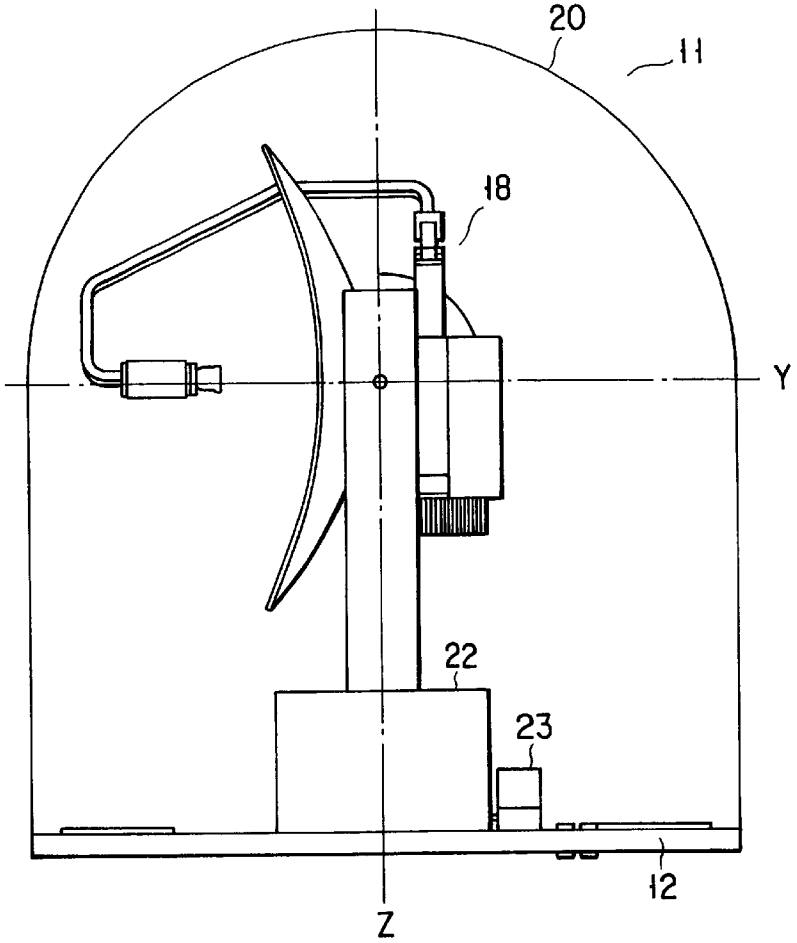
FIGS. 5A and 5B are a front view and a side view, respectively, of the antenna apparatus of FIG. 3.
Figure 5A:
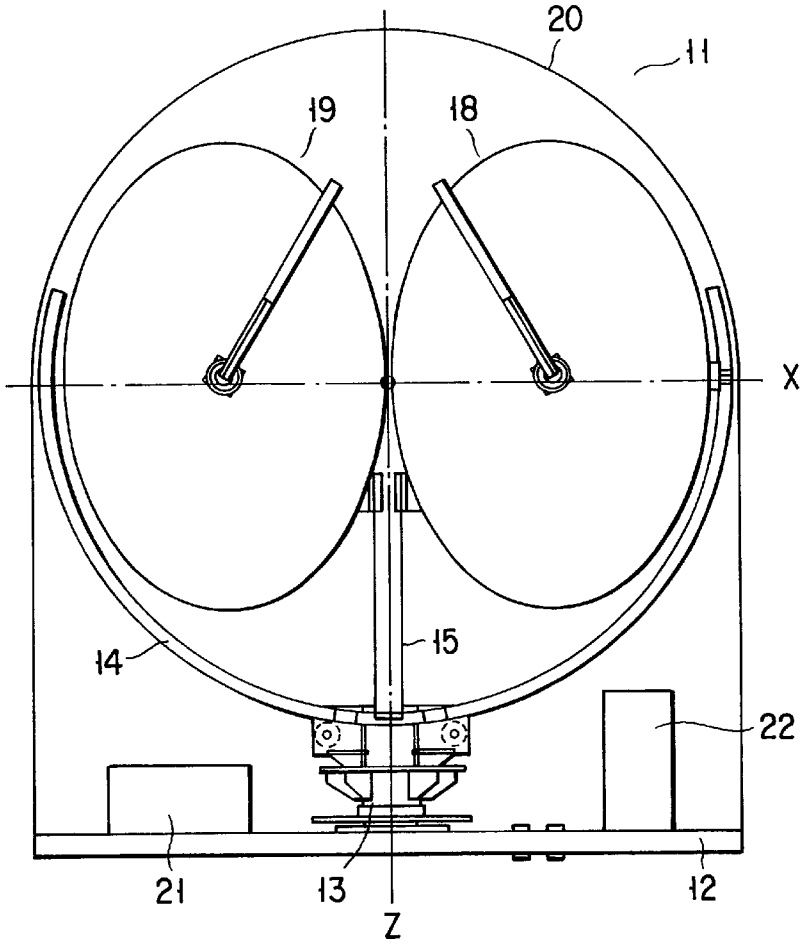

FIGS. 3, 4, 5A and 5B are schematic illustrations of an antenna system 11 according to an embodiment of the present invention. More specifically, FIG. 3 is a front perspective view of the antenna system 11, FIG. 4 is a rear perspective view, FIG. 5A is a front view, and FIG. 5B is a side view.

As shown in FIGS. 3, 4, 5A and 5B, the antenna system 11 is provided with a fixed base 12 which is substantially circular in shape and fixed horizontally in an installation place. In the center of the fixed base is placed a rotating base 13 which rotates about a first rotation axis (hereinafter referred to as Z axis) extending in the vertical direction with respect to the surface of the fixed base 12. A support rail 14, formed by curving a flat plate into a semicircular arc having a constant radius of curvature, is placed rotatably over the rotary base 13 with its center of rotation placed on the Z axis. The rotation axis of the support rail is defined as a second rotation axis (hereinafter referred to as Y axis) perpendicular to the Z axis.

The support rail 14 is provided with a support shaft 15 which extends from its middle to the center of the arc. First and second shafts 16 and 17 are supported rotatably independent of each other between the arc center and one end of the support rail and between the arc center and the other end. That is, the support shaft 15 and each of the first and second rotary shafts 16 and 17 intersect at right angles at the arc center of the rail 14. The first and second shafts 16 and 17 form a third rotation axis (hereinafter referred to as X axis) perpendicular to the Y axis.

Parabolic antennas 18 and 19 are respectively mounted to the first and second rotating shafts 16 and 17 on opposite sides of the arc center of the support rail 14 so that they have directivity in the direction perpendicular to the shafts 16 and 17 (the X axis). That is, each of the parabolic antennas 18 and 19 can be independently rotated about the X axis with the rotation of a corresponding one of the rotating shafts 16 and 17.

The entire apparatus thus assembled is covered with a radome 20 of ∩ shaped section. The radome has its portion above the Y axis (the second rotation axis) formed in the shape of a hemisphere.

Although the apparatus has been outlined so far, details of the apparatus will be given hereinafter.

A regulator 21 and a processor 22 are placed on the peripheral portion of the fixed base 12. A Z-axis driving motor 23 is placed in the neighborhood of the rotating base 13 positioned in the center of the fixed base.

Figure 6:
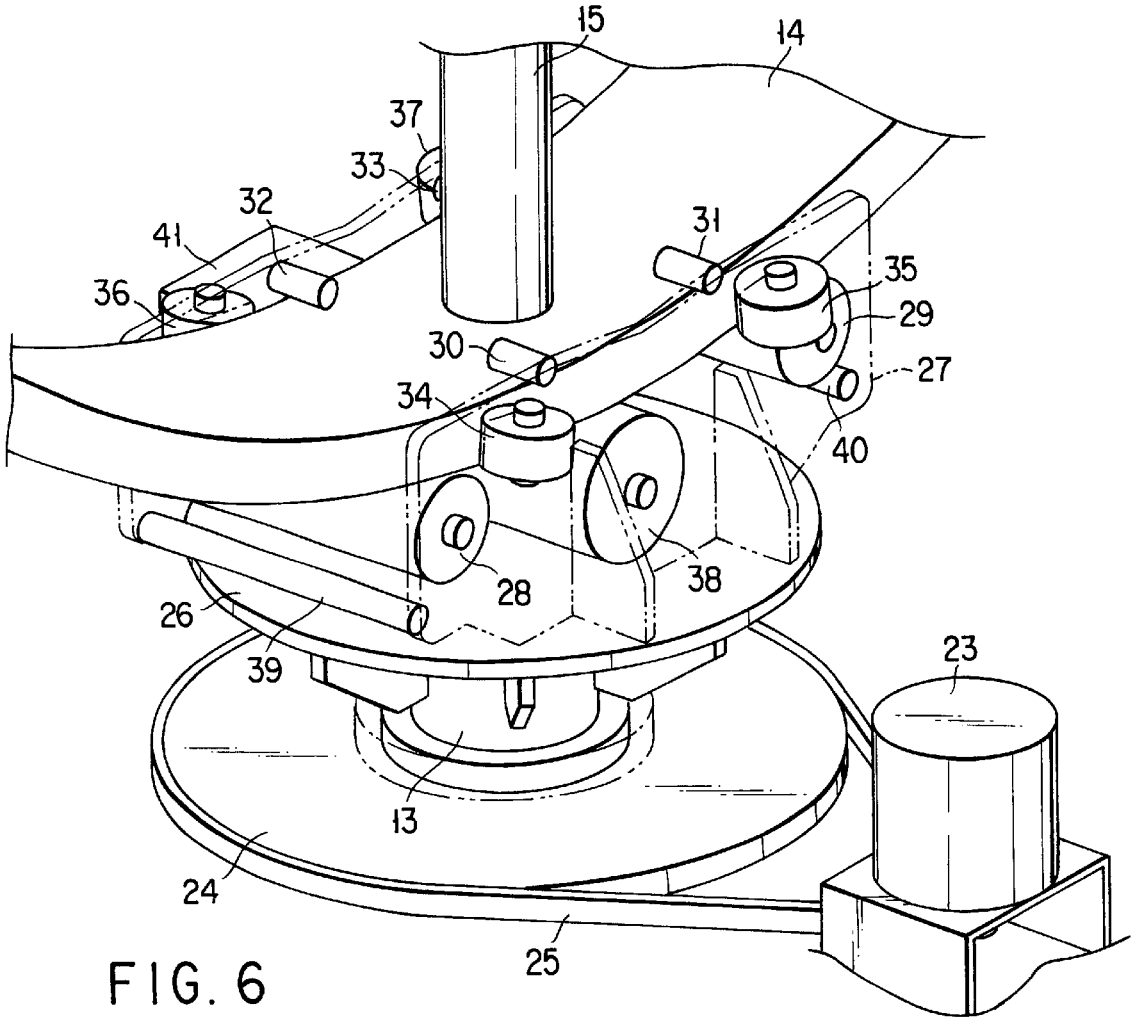
FIG. 6 is an enlarged perspective view of the Z-axis rotation driving mechanism for the rotating base and the Y-axis rotation driving mechanism for the support rail in the apparatus of FIG. 3.

FIG. 6 illustrates, in enlarged perspective, the Z-axis rotating mechanism of the rotating base 13 and the Y-axis rotating mechanism of the support rail 14. In FIG. 6, 24 denotes a pulley attached to the Z axis, which is coupled by a belt 25 with the axis of rotation of the Z-axis driving motor 23 on the fixed base 12. Thus, the rotation of the motor 23 is transmitted to the pulley, allowing the rotating base 13 to rotate about the Z axis. The motor is driven by the processor 22 in a controlled manner.

A base plate 26 is placed over the rotating base 13. A supporting member 27 of ∪-shaped cross section is placed on the base plate. Rotatably supported by the supporting member 27 are a pair of rollers 28 and 29 which hold the support rail 14 from its under surface side, four rollers 30, 31, 32 and 33 which hold the rail from its upper surface side, four rollers 34, 35, 36 and 37 which hold the rail from its sides, a large-diameter feed roller 38 and a pair of tension rollers 39 and 40. The rollers 38, 39 and 40 are provided below the support rail 14 and forms a wire feed mechanism. To the base plate 26 or the supporting member 27 is attached a motor 41 for rotating the feed roller 38. The length of the upper surface holding rollers 30, 31, 32 and 33 is set so that they will not get in the way of the shaft 15 and the rotating shafts 16 and 17 when the support rail 14 is rotated.

Figure 8:
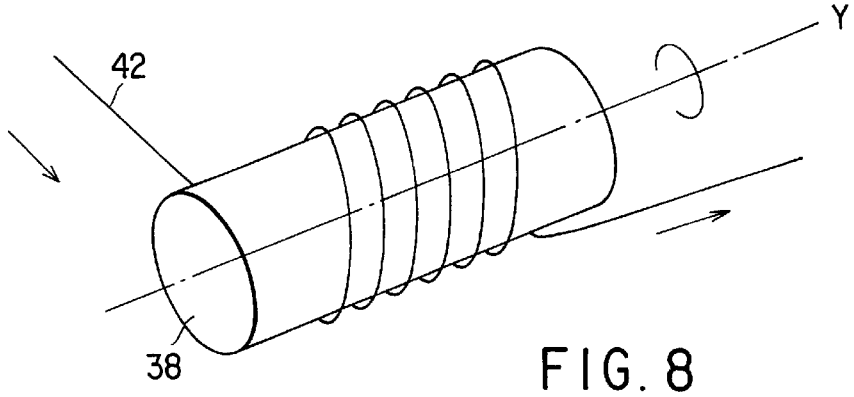
FIG. 8 is an enlarged perspective view of the heart of the wire feed mechanism of FIG. 7.
Figure 7:
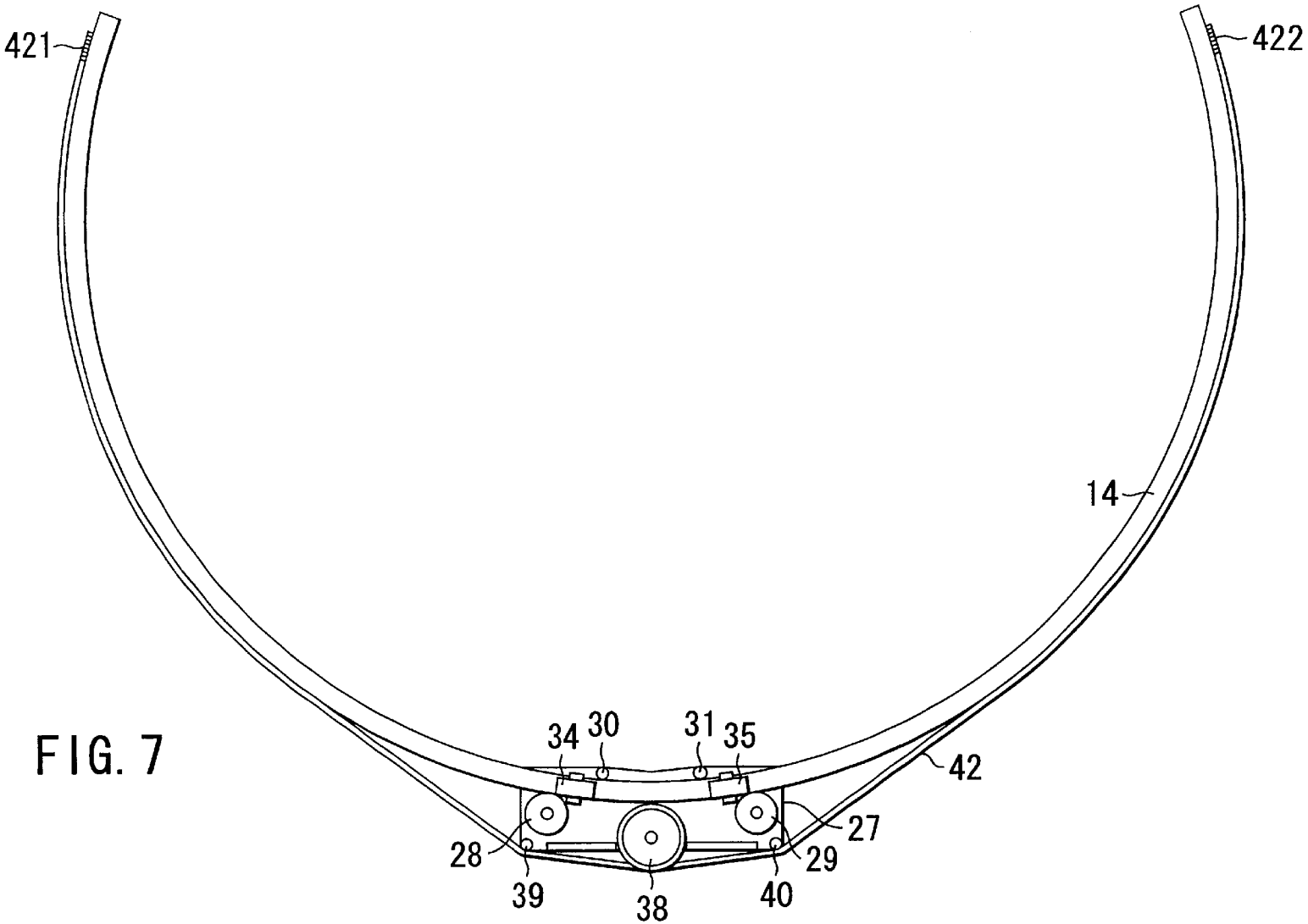
FIG. 7 illustrates the wire feed mechanism for the support rail used in the antenna apparatus of FIG. 3.

FIG. 7 is a side view of the wire feed mechanism and FIG. 8 is an enlarged perspective view of the wire feed section. In these figures, 42 denotes a wire, which has its both ends fixed to the ends of the support rail 14, is wound onto the feed roller 38 several turns in spiral, and is supported by the tension rollers 39 and 40 in such a way that it is pushed in a direction away from the support rail 14. That is, the tension rollers can prevent the wire 42 from twining around the rollers 28 and 29 and allows the wire to be wound onto the roller 38 uniformly. In this state rotating the feed roller 38 in one direction or the reverse direction by means of the motor 41 allows the support rail 14 to turn around the Y axis in one direction or the reverse direction. The motor is driven by the processor 22 in a controlled manner.

Both the ends of the wire 42 are associated with elastic members 421 and 422, such as tension springs, that have modulus for backlash purposes. Thereby, the extension of the wire can be absorbed and the condition in which the wire is tightly wound onto the feed roller 38 can be maintained. The two elastic members 421 and 422 are not necessarily required and one of them can be dispensed with.

Figure 9:
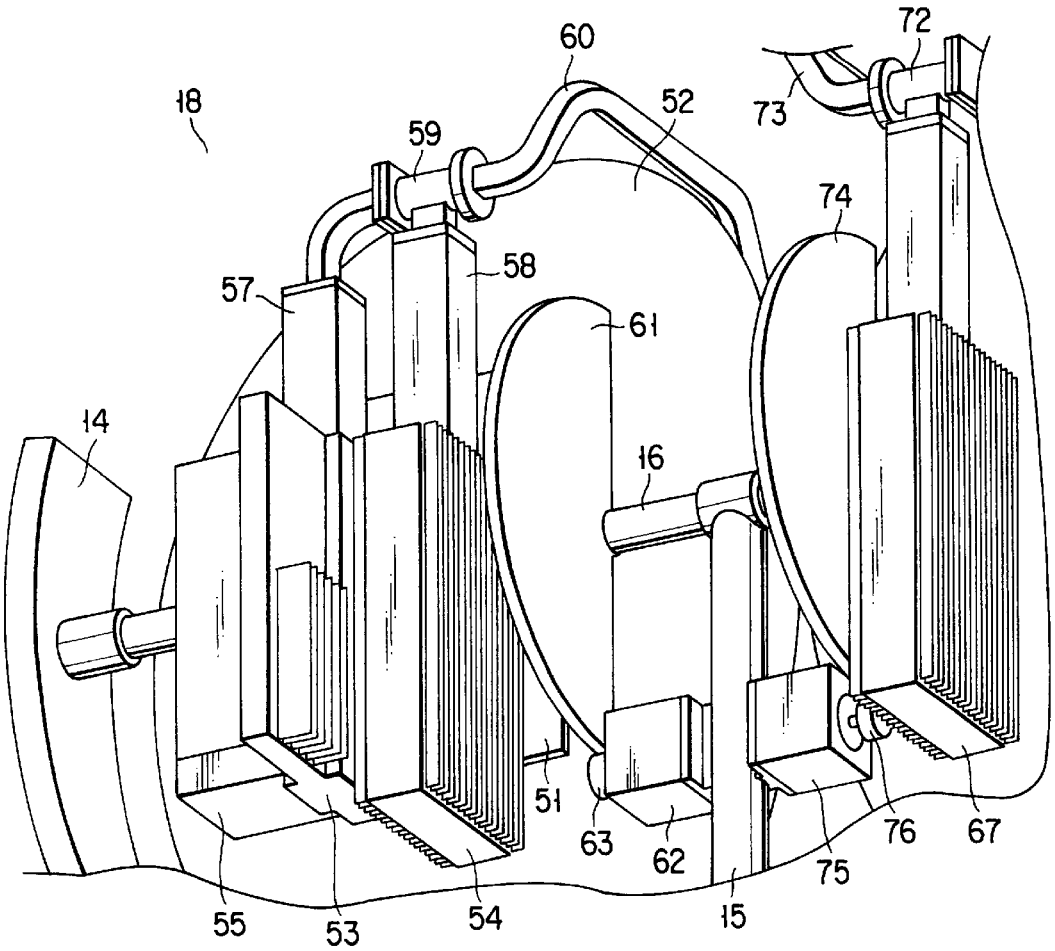
FIG. 9 is an enlarged perspective view of the first parabolic antenna shown in FIG. 8 and its mechanism for rotation about the X axis.

FIG. 9 illustrates, in perspective view, the structure of the first parabolic antenna 18 and the mechanism for its turning around the X axis. In FIGS. 3, 4, 5A, 5B, 6 and 7, the parabolic antenna is constructed such that its mounting plate 51 is fixed to the first rotating shaft 16 and has its one side attached to the back of the reflector 52 and its opposite side mounted with an up converter 53, a down converter 54, and a cooling unit (a heat sink, a fan, etc.) 55, and the horn feed (primary radiator) 56 is placed at the focus of the reflector 52. In order to obtain a maximum of aperture area, the reflector is formed in the shape of an ellipse having its long axis in the direction perpendicular to the X axis. The up converter 53 and the down converter 54 are connected to the regulator by means of a composite cable not shown for power supply.

The output of the up converter 53 is coupled to a transmitting bandpass filter unit 57 and the input of the down converter 54 is coupled to a receiving bandpass filter unit 58. These filter units are coupled by a T junction 59, which is in turn coupled with the horn 56 by means of the waveguide 60. The components 53, 54, 55, 57, 58 and 59 constitute a transmit-receive module.

The waveguide 60 is bent appropriately so that the horn feed 55 is positioned at the focus of the reflector 52. Since the waveguide functions as a stay of the horn feed, there is no need to provide an additional stay of the horn feed. However, the waveguide acts as a shadow within the plane of radiation, forming a cause of blocking. To avoid this, the waveguide is simply pasted or coated on top with an electromagnetic-wave absorbing material. This makes it possible to suppress unwanted radiation from the waveguide 60 and thereby ensure a good sidelobe characteristic.

To pull out the waveguide from the rear side of the reflector to the front side, it is advisable to set the pullout place on an axis tilted at an angle relative to the long axis of the reflector toward the center side of the support rail 14. By so doing, the efficient utilization of the dead space in the radome 20 can be effected.

The mechanism for rotation about the X axis in the parabolic antenna 18 constructed as described above will be described below. A sector gear 61 in the shape of a semicircular disc is mounted to that portion of the rotating shaft 16 which is on the side of the support shaft 15 and an X-axis driving motor 62 is attached to the support shaft 15. A pinion gear 63 is mounted to the rotating shaft of the motor 62 so that it engages with the sector gear 61. Thereby, the rotation of the motor 62 is transmitted to the rotating shaft 16 with reduced speed, whereby the first parabolic antenna 18 fixed to the rotating shaft 16 is permitted to rotate through an angle of about 180 degrees. The motor 62 is driven by the processor 22 in a controlled manner.

The second parabolic antenna 19 and its mechanism for rotation about the X axis are constructed in exactly the same way as with the first parabolic antenna 18. That is, the second parabolic antenna 19 is composed of a mounting plate 64, a reflector 65, an up converter 66, a down converter 67, a cooling unit 68, a horn feed 69, a transmitting bandpass filter unit 70, a receiving bandpass filter unit 71, a T junction 72, and a waveguide 73. The mechanism for rotation about the X axis comprises a sector gear 74, an X-axis driving motor 75, and a pinion gear 76. The motor 75 is driven by the processor 22 in a controlled manner. The components 66, 67, 68, 70, 71 and 72 constitute a transmit-receive module.

The first and second parabolic antennas 18 and 19 thus constructed are each allowed to rotate about each of the three axes: the X-axis by the rotating shafts 16 and 17, the Y axis by the support rail 14, and the Z axis by the rotating base 13. Moreover, each of the first and second parabolic antennas can be rotated independently. By driving each of the driving motors in a controlled manner through the processor 22, therefore, each of the first and second parabolic antennas can be oriented to a respective one of two satellites placed in different orbits.

Here, circularly polarized waves are used for communication between parabolic antennas 18 and 19 and communication satellites and each antenna is used for both transmission and reception; thus, different frequencies are used for transmission and reception.

In this case, perpendicularly polarized waves are caused to propagate in each of the waveguides 60 and 73. In the apparatus of the invention, it is required to bend the waveguides 60 and 73. In passing differently polarized waves, a higher mode is generated in a polarized wave perpendicular to the bent axis (the TM10 mode for circular waveguides and the TM11 mode for rectangular waveguides). With circular waveguides in particular, orthogonality breaks through bending, which will make crosstalk easy to occur.

Figure 10:
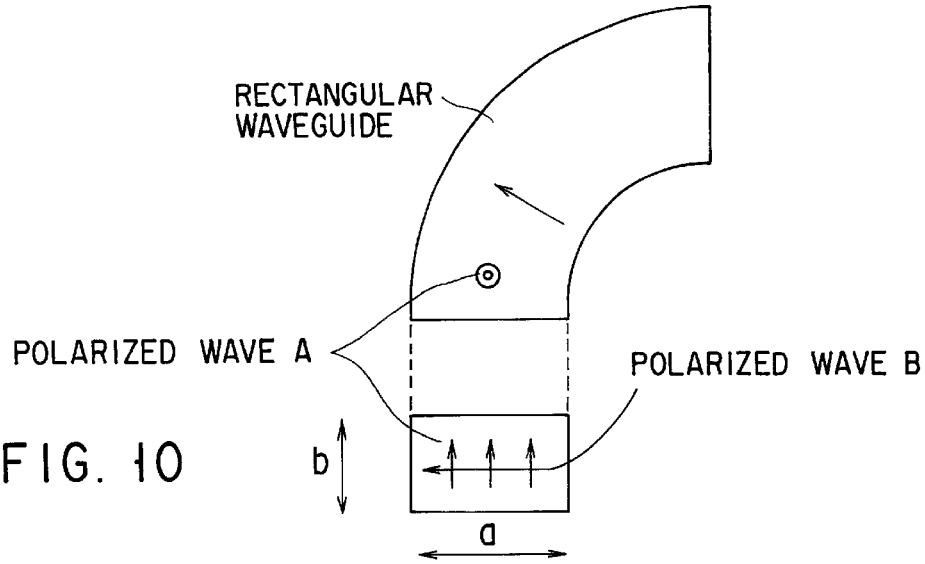
FIG. 10 is a plan view and a cross-sectional view of the waveguide used in the antenna apparatus of FIG. 3.

The inventive antenna apparatus suppresses the generation of the higher mode by using such a rectangular waveguide as shown in FIG. 10 and determining its dimensions appropriately. The principles of suppression of the higher mode will be described below.

First, suppose that waves which propagate in the rectangular waveguide are λiA and λiB which are polarized perpendicular to each other (i=1, 2, . . . , n). To solve the above problem, the size of the waveguide is determined so as to cutoff the fundamental mode (TE11) of each wave. Here, the size of the waveguide is a in width and b in height as shown in FIG. 10.

To allow a wave to propagate in the fundamental mode, its wavelength λ is required to be λ≦2a. Since λ=c/f (c=velocity of light, f=frequency), the conditions under which the polarized waves A and B are allowed to propagate are given by $$a \geqq c/2f_1^A,\ b \geqq c/2f_1^B \tag{1}$$

where $f_1^A$ and $f_1^B$ are the lowest frequencies in the waves A and B, respectively.

The width a and the height b are determined so as to satisfy expression (1) and expression (2) below.

$$fc^{TM}11 = c \Big/ \frac{2ab}{\sqrt{a^2+b^2}} \tag{2}$$

where $fc^{TM}11$ is the cutoff frequency of the mode $^{TM}11$.

For instance, with a radar system in which a parabolic antenna apparatus is frequently used, the transmit frequency and the receive frequency are the same. When the operating frequency is assumed to be f, since $f=f_1^A=f_1^B$ and a=b, a square waveguide bend should be chosen which has the dimension a that meets the condition:

$$\frac{c}{2f} \leqq a \leqq \frac{c}{\sqrt{2}\,f} \tag{3}$$

In contrast, the inventive apparatus is used for communication purposes and hence the transmit frequency and the receive frequency differ. That is, $f_1^A \neq f_1^B$, $a=c/2f_1^A$, and $b=c/2f_1^B$. Therefore, a rectangular waveguide bend should be chosen which allows the propagation of perpendicularly polarized waves less in frequency than fcTM11 given by $$fc^{TM}11=\sqrt{(f_1^A)^2+(f_1^B)^2} \tag{4}$$

Thus, the inventive antenna apparatus, while using bent waveguides, can suppress the occurrence of the higher mode in bends and satisfy electrical characteristics by using rectangular waveguides and determining their dimensions to conform to transmit and receive polarized waves which are perpendicular to each other.

The processor 22 is connected with an external host computer HOST for receiving information concerning the locations and orbits of satellites.

Figure 11:
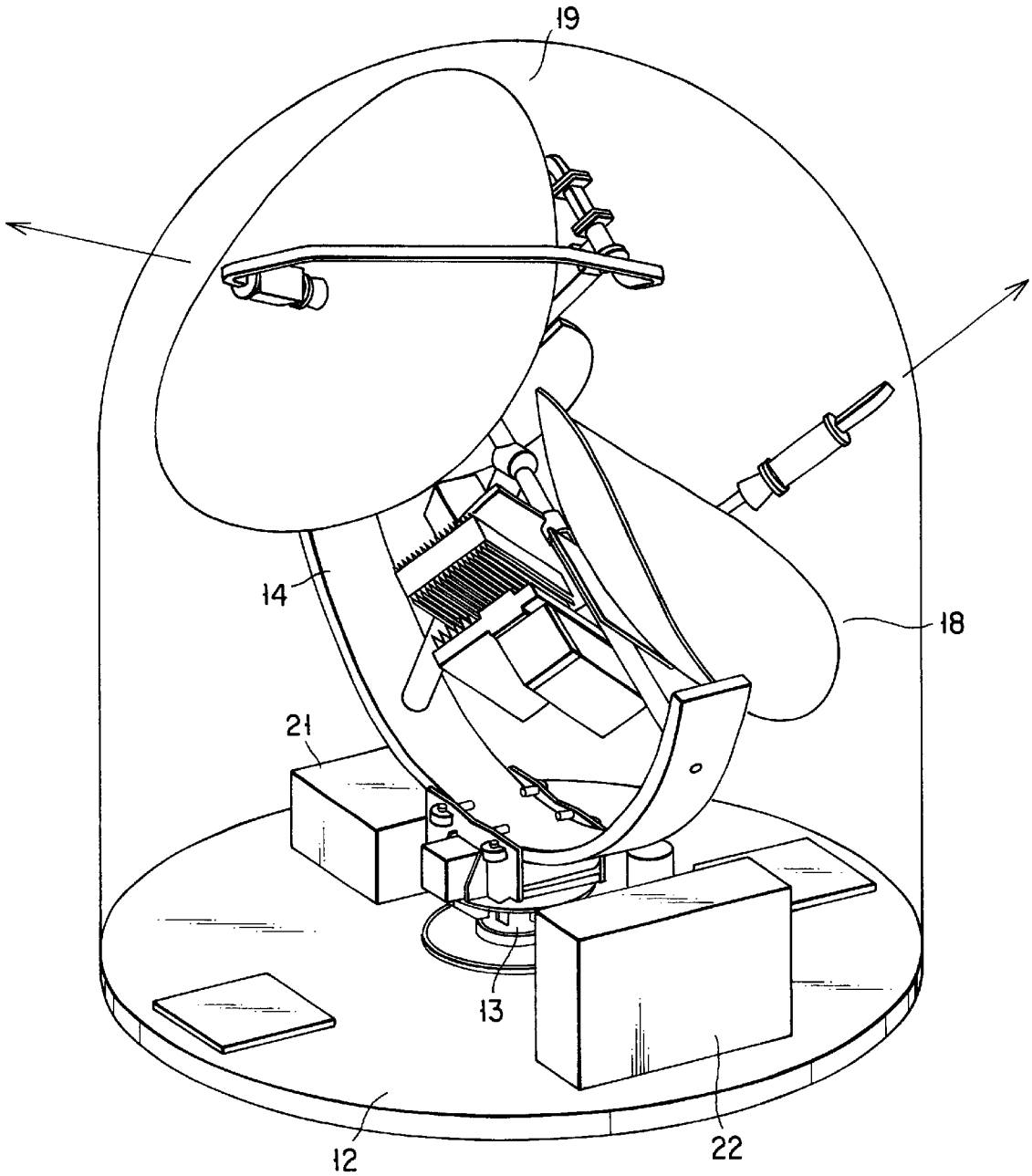
FIG. 11 illustrates a state where the first and second parabolic antennas of the antenna apparatus of FIG. 3 are oriented toward two satellites.
Figure 12:
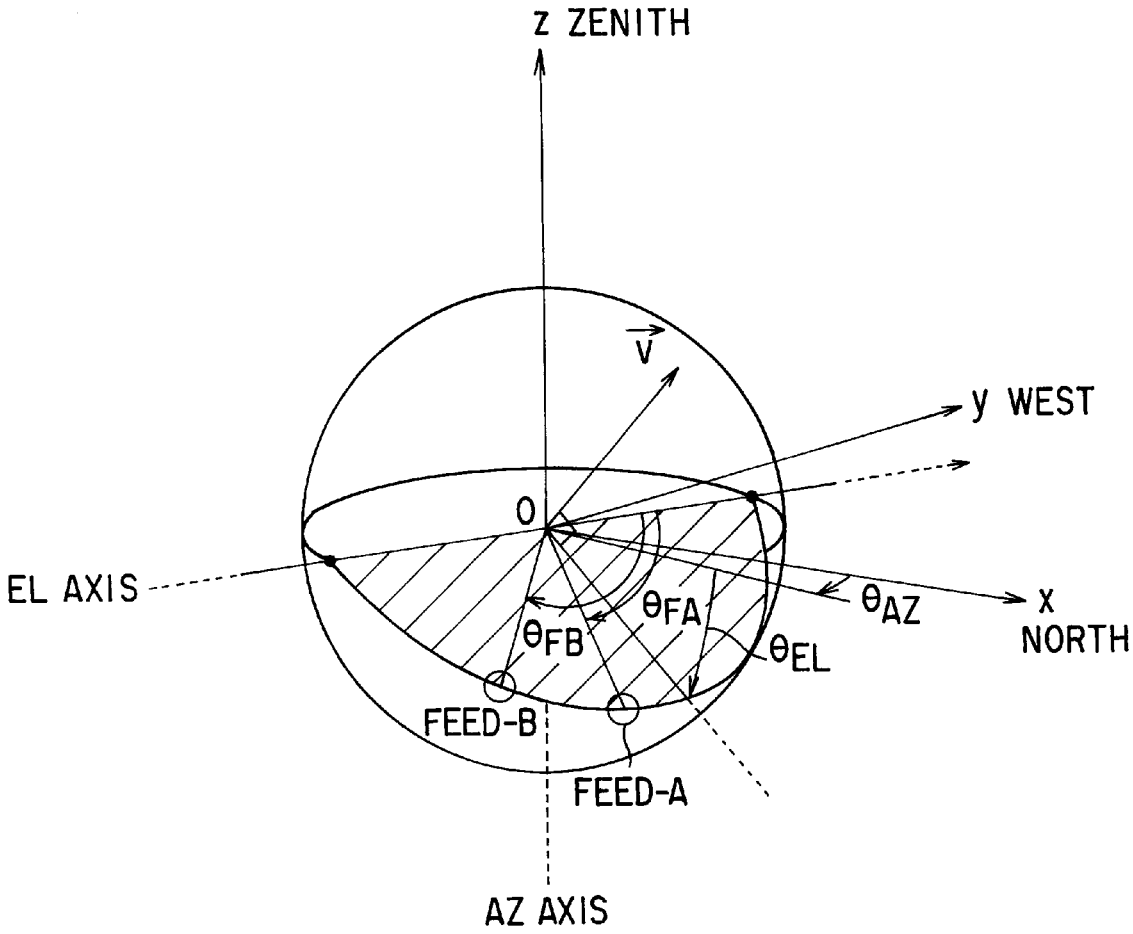
FIG. 12 is a diagram for use in explanation of the coordinate system of the antenna apparatus of FIG. 3 and rotation control of the axes.

The satellite tracking operation of the antenna apparatus 11 will be described next with reference to FIGS. 11 and 12. FIG. 11 illustrates a state in which the first and second parabolic antennas 18 and 19 are oriented toward two satellites. FIG. 12 illustrates a coordinate system associated with the antenna apparatus 11 for control of the rotation of each axis.

First, a base coordinate system O-xyz is set up in which the x axis points to the north, the y axis to the west, and the z axis to the zenith with the earth fixed. At the time of installation of the antenna apparatus 11, the X, Y and Z axes of the apparatus are aligned with the x, y and z axes, respectively, of the base coordinate system. The origin O of the base coordinate system is set at the arc center of the support rail 14. Two satellites to be tracked are identified as A and B. Even if the coordinate systems are displaced relative to each other, the displacement can be compensated for by determining an error angle between the coordinate systems at the time of control of orientation of the antennas.

Here, the azimuth angle $\theta_{AZ}$ and the elevation angle $\theta_{EL}$ of the antenna and the feed angles $\theta_{FA}$ and $\theta_{FB}$ of the two satellites A and B are defined as follows:

The azimuth angle $\theta_{AZ}$: The azimuth axis (AZ axis) is aligned with the z axis of the rotating base 13 and $\theta_{AZ}$ is measured in relation to the x axis (0°). The angle is taken to be positive in the counterclockwise direction with respect to the z axis. The azimuth angle $\theta_{AZ}$ is set such that $-180° \leqq \theta_{AZ} \leqq 180°$.

The elevation angle $\theta_{EL}$: The elevation axis is aligned with the y axis when $\theta_{AZ}=0°$. The angle is set to be 0° when the shafts 16 and 17 of the support rail 14 are in parallel to the base 12 and taken to be positive in the clockwise direction with respect to the EL axis. The elevation angle $\theta_{EL}$ is set such that $0° \leqq \theta_{EL} \leqq 180°$.

The feed angles $\theta_{FA}$ and $\theta_{FB}$: A sphere of unity in radius is imagined with center at the origin O. On the plane (shaded area in FIG. 10) formed by the center O of the imaginary sphere and the points FEED A and FEED B of projection of the two satellites A and B on the imaginary sphere, $\theta_{FA}$ and $\theta_{FB}$ are defined as shown. $\theta_{FA}$ and $\theta_{FB}$ are set such that $0° \leqq < \theta_{FA}\theta_{FB} \leqq 180°$ In the coordinate system thus defined, vectors $\vec{a}$ and $\vec{b}$ of the two satellites A and B on the imaginary sphere are represented by $$\vec{a}=(a_1, a_2, a_3) \tag{5}$$

$$\vec{b}=(b_1, b_2, b_3)$$

The vector representing the reference orientation of the two parabolic antennas 18 and 19 on the imaginary sphere is represented by $\vec{v}$ as follows:

$$\begin{aligned}\vec{v} &= (-a_2 \cdot b_3 + a_3 \cdot b_2 - a_3 \cdot b_1 + a_1 \cdot b_3 - a_1 \cdot b_2 + a_2 \cdot b_1) \\ &= (v_1, v_2, v_3)\end{aligned} \tag{6}$$

The vector of the EL axis, $\overrightarrow{EL}$, is represented by $$\overrightarrow{EL}=\vec{v}\times\vec{z}=(v_2-v_1, 0)$$

$$\vec{v}=(v_1, v_2, v_3),\ \vec{z}=(0,0,1)\overrightarrow{EL}(el_1, el_2, el_3) \tag{7}$$

As a result, the elevation angle $\theta_{EL}$ and the azimuth angle $\theta_{AZ}$ are represented by $$\begin{aligned}&\theta_{EL} = \cos^{-1}\left(v_3 \Big/ \sqrt{v_1^2+v_2^2+v_3^2}\right) \\ &(0° \leqq \theta_{EL} \leqq 180°) \\ &\theta_{AZ} = V_2 \geqq 0 : -\cos^{-1}\left(v_1 \Big/ \sqrt{v_1^2+v_2^2}\right) \\ &(-180° \leqq \theta_{AZ} \leqq 0°) \\ &V_2 < 0 : \cos^{-1}\left(v_1 \Big/ \sqrt{v_1^2+v_2^2}\right) \\ &(0° \leqq \theta_{AZ} \leqq 180°)\end{aligned} \tag{8}$$

On the other hand, $\cos\theta_{FA}$ and $\cos\theta_{FB}$ are represented by $$\begin{aligned}\cos\theta_{FA} &= (\overrightarrow{EL}\cdot\vec{a}) \big/ |\overrightarrow{EL}|\cdot|\vec{a}| \\ \cos\theta_{FB} &= (\overrightarrow{EL}\cdot\vec{b}) \big/ |\overrightarrow{EL}|\cdot|\vec{b}|\end{aligned} \tag{9}$$

Therefore, $\theta_{FA}$ and $\theta_{FB}$ are represented by $$\theta_{FA}=\cos^{-1}(el_1\cdot a_1+el_2\cdot a_2+el_3\cdot a_3/\sqrt{el_1^2+el_2^2+el_3^2}\cdot 1)$$

$$\theta_{FB}=\cos^{-1}(el_1\cdot b_1+el_2\cdot b_2+el_3\cdot b_3/\sqrt{el_1^2+el_2^2+el_3^2}\cdot 1) \tag{10}$$

The processor 22 calculates the time-varying angles $\theta_{FA}$ and $\theta_{FB}$ on the basis of information about the locations and orbits of the satellites from the host computer and then controls the driving mechanism for the X, Y and Z axes accordingly. The two satellites A and B can therefore be tracked by the first and second parabolic antennas 18 and 19.

As can be seen from the foregoing, the inventive antenna apparatus can track two satellites which are independent of each other in the sky. At this point, each of the parabolic antennas 18 and 19 does not suffer electrical blocking and mechanical interference from the other though they are mounted to the common axis (X axis) and driven independently.

The driving of the Y axis is performed by sliding the support rail 14 in the shape of a semicircle and that no physical axis is provided for the Y axis, thus increasing the space efficiency. In this case, the support rail 14 is formed in the shape of a semicircle but not a circle, thus preventing an antenna beam from being blocked.

In the embodiment, the under, upper and side surfaces of the support rail 14 as the Y-axis driving mechanism are supported with rollers to restrict weighting and moment in the direction of gravity and other directions. As an alternative, the Y-axis driving mechanism may use a V-shaped rail and rollers.

According to the mounting structure of the inventive antenna apparatus, the X, Y and Z axes are set up in the neighborhood of the center of gravity of the apparatus, allowing the motor size to be reduced dramatically. Further, the antenna outline can be limited, allowing the diameter of the radome to be reduced and consequently the electrical aperture (the diameter of the reflector) to be increased to a maximum. In this case, since each parabolic antenna uses a center-feed ellipse-shaped beam, the electrical aperture in the radome can be enlarged to a maximum.

Here, the center feed is inferior in blocking to the offset feed but superior in space for installation. In the inventive apparatus, a waveguide is used as a stay for a horn feed and the waveguide is pasted or coated with an electromagnetic wave absorbing material, thereby suppressing or minimizing the degradation of sidelobe characteristics due to blocking, which is the problem associated with the center feed.

When pulling out from the rear side of the reflector to the front side, the waveguide is pulled out from between the long and short axes of the elliptic reflector, thus requiring less installation space.

The waveguide used is rectangular in shape and its dimensions are set to conform to two perpendicularly polarized waves, making the higher mode due to bending difficult to generate.

To rotate the support rail having no rotation axis, a wire driving method is used, realizing a stable sliding operation.

For X-axis driving of the parabolic antennas 18 and 19, sector gears in the shape of a semicircular disc are used, saving the space behind the reflectors.

Although the embodiment has been described as using a reflector type of antenna composed of a reflector and a primary radiator, use may be made of an array type of antenna in which a number of antenna elements are arranged in a plane.

As described above, the present invention can provide an antenna apparatus which is capable of tracking two satellites simultaneously which is so compact that it can be installed in relatively small space.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna apparatus comprising:

a fixed base having a datum plane and fixed in an installation place;

a rotating base placed on the fixed base and adapted to be rotatable about a Z axis perpendicular to the datum plane;

a support rail in the shape of substantially a semicircular arc, the rail being placed over the rotating base and adapted to be rotatable about a Y axis perpendicular to the Z axis with its central point on the Z axis and the Y axis passing through the central point of the support rail;

first and second rotating shafts provided between an end of the support rail and the central point and between the other end of the support rail and the central point, respectively, to form an X axis perpendicular to the Y axis and adapted to be rotatable about the X axis independently of each other;

first and second antennas fixed to the first and second rotating shafts, respectively;

a Z-axis rotating mechanism for allowing the fixed base to rotate about the Z axis;

a Y-axis rotating mechanism for allowing the support rail to rotate about the Y axis; and first and second X-axis driving mechanisms for rotating the first and second rotating shafts about the X axis independently of each other.

2. The antenna apparatus according to claim 1, further comprising: a radome placed on the fixed base configured to entirely cover the apparatus.

3. The antenna apparatus according to claim 1, wherein each of the first and second antennas has a primary radiator and a reflector and is mounted to a corresponding one of the first and second rotating shafts so that a directivity of each of the first and second antennas is perpendicular to the X axis.

4. The apparatus according to claim 3, wherein each of the reflectors of the first and second apparatus is formed in the shape of an elipse, a major axis of which extends in a direction perpendicular to the X-axis.

5. The apparatus according to claim 4, wherein at least one end of the wire is associated with an elastic member having modulus.

6. The apparatus according to claim 5, wherein the waveguide is a rectangular waveguide, the width and height of which are determined according to two polarized waves used for transmission and reception and a frequency of the two polarized waves.

7. The apparatus according to claim 6, wherein each of the first and second antennas has a transmit-receive module mounted on the backside of the corresponding reflector, the module and the corresponding primary radiator on the front side of the reflector being coupled by a waveguide and the primary radiator being supported by the waveguide.

8. The apparatus according to claim 7, wherein the waveguide is a rectangular waveguide the width and height of which are determined according to two polarized waves used for transmission and reception and their frequencies.

9. The apparatus according to claim 1, wherein the Y-axis rotating mechanism is adapted to rotate the support rail about the Y axis by attaching ends of a wire to the ends of the support rail in the direction of the length, winding the wire onto a roller, and rotating the roller in one direction or reverse direction.

10. The apparatus according to claim 3, wherein the support rail has a support shaft extending from its middle to the central point and supporting the first and second rotating shafts at the central point, and each of the first and second X-axis driving mechanisms includes a sector gear in the shape of a semicircular disc which is mounted to the backside of the reflector of a corresponding one of the first and second antennas and a motor having a pinion gear and fixed to the support shaft so that the pinion gear is engaged with the sector gear, the motors of the first and second X-axis driving mechanisms being driven independently to rotate the first and second antennas about the X axis.

11. A bent waveguide configured to transmit two signals and having a rectangular cross section, wherein each of the two signals has a different frequency, the two signals are in the form of two polarized waves perpendicular to one other, and a height and width of the bent waveguide are determined based on the polarized waves and the frequencies of the two signals.

12. An antenna apparatus comprising:

a fixed base having a datum plane and fixed in an installation place;

a rotating base placed on the fixed base and configured to be rotatable about a Z axis perpendicular to the datum plane;

a support rail having a shape of substantially a semicircular arc, the support rail being placed over the rotating base and configured to be rotatable about a Y axis perpendicular to the Z axis and having a central point on the Z axis, the Y axis passing through the central point of the support rail;

a first and a second rotating shaft, the first rotating shaft being positioned between a first end of the support rail and the central point, the second rotating shaft being positioned between a second end of the support rail and the central point, the first rotating shaft and the second rotating shaft forming an X axis perpendicular to the Y axis, and the first rotating shaft and the second rotating shaft being configured to be rotatable about the X axis independently of each other;

a first and a second antenna, the first antenna being fixed to the first rotating shaft and the second antenna being fixed to the second rotating shaft;

a Z-axis rotating mechanism configured to allow the fixed base to rotate about the Z axis;

Y-axis rotating mechanism configured to allow the support rail to rotate about the Y axis; and a first and second X-axis driving mechanism, the first X-axis driving mechanism configured to rotate the first rotating shaft and the second rotating shaft about the X axis independently of each other.

13. The antenna apparatus of claim 12, further comprising:

a radome placed on the fixed base configured to entirely cover the apparatus.

14. The antenna apparatus of claim 12, wherein:

each of the first antenna and the second antenna has a primary raidator and a reflector and is mounted to a corresponding one of the first rotating shaft and the second rotating shaft so that a directivity of each of the first antenna and the second antenna is perpendicular to the X axis.

15. The apparatus of claim 14, wherein:

the reflector of the first antenna and the reflector of the second antenna each being formed in a shape of an ellipse having a major axis extending in a direction perpendicular to the X axis.

16. The apparatus of claim 15, wherein:

the first antenna and the second antenna each having a corresponding transmit receive module mounted on a back side of a corresponding reflector, the transmit receive module and a corresponding primary radiator on a front side of the corresponding reflector being coupled by a waveguide, and a corresponding primary radiator being supported by the waveguide.

17. The apparatus of claim 16, wherein:

the waveguide is a rectangular waveguide having width and a height determined according to two polarized waves used for transmission and reception and a frequency of the two polarized waves.

18. The apparatus of claim 16, wherein:

a place where the waveguide is pulled out from the back side to the front side of the corresponding reflector is set between a long axis of the reflector and a short axis of the reflector.

19. The apparatus of claim 14, wherein:

the support rail has support shaft extending from a middle of the support rail to the central point of the support rail and configured to support the first rotating shaft and the second rotating shaft at the central point, the first X-axis driving mechanism and the second X-axis driving mechanism each includes a sector gear having a shape of a semicircular disc and mounted to a back side of a reflector of a corresponding one of the first antenna and the second antenna and a motor having a pinion gear being fixed to the support shaft so that the pinion gear is engaged with the sector gear, and a motor of the first X-axis driving mechanism and a motor of the second X-axis driving mechanism each being driven independently to respectively rotate the first antenna and the second antenna about the X axis.

20. The apparatus of claim 12, wherein:

the Y-axis rotating mechanism is configured to rotate the support rail about the Y axis by attaching a first end of a wire to the first end of the support rail and a second end of the wire to the second end of the supprt rail in a direction of a length of the support rail, and the wire being wound onto a roller configured to rotate the support rail in a first direction by rolling the roller in a first direction, and to rotate the support rail in a second direction by rolling the roller in a second direction opposite to the first direction.

21. The apparatus of claim 17, wherein:

at least one end of the wire is associated with an elastic member having modulus.

* * * * *